US008657652B2

(12) United States Patent
Hwang et al.

(10) Patent No.: US 8,657,652 B2
(45) Date of Patent: Feb. 25, 2014

(54) OPTIMIZED CMP CONDITIONER DESIGN FOR NEXT GENERATION OXIDE/METAL CMP

(75) Inventors: Taewook Hwang, Acton, MA (US); J. Gary Baldoni, Norfolk, MA (US); Thomas Puthanangady, Shrewsbury, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1165 days.

(21) Appl. No.: 12/195,600

(22) Filed: Aug. 21, 2008

(65) Prior Publication Data

US 2009/0053980 A1 Feb. 26, 2009

Related U.S. Application Data

(60) Provisional application No. 60/965,862, filed on Aug. 23, 2007.

(51) Int. Cl.
*B24B 53/00* (2006.01)

(52) U.S. Cl.
USPC ..... 451/443; 451/56

(58) Field of Classification Search
USPC ..... 451/443, 444, 72, 56, 21, 5
See application file for complete search history.

(56) References Cited

U.S. PATENT DOCUMENTS

| | | | |
|---|---|---|---|
| 2,194,472 | A | 3/1940 | Jackson |
| RE26,879 | E | 5/1970 | Kelso |
| 4,925,457 | A | 5/1990 | Dekok et al. |
| 4,931,069 | A | 6/1990 | Wiand |
| 5,014,468 | A | 5/1991 | Ravipati et al. |
| 5,049,165 | A | 9/1991 | Tselesin |

(Continued)

FOREIGN PATENT DOCUMENTS

| | | | |
|---|---|---|---|
| CN | 1867428 | A | 11/2006 |
| DE | 69210221 | T2 | 1/1997 |

(Continued)

OTHER PUBLICATIONS

International Search Report and Written Opinion of the International Searching Authority dated Nov. 26, 2008 from counterpart International Application No. PCT/US2008/073823, filed on Aug. 21, 2008.

(Continued)

*Primary Examiner* — Robert Rose
(74) *Attorney, Agent, or Firm* — Joseph P. Sullivan; Abel Law Group, LLP

(57) ABSTRACT

A study of several key conditioner design parameters has been conducted. The purpose was to improve conditioner performance by considering factors such as wafer defects, pad life, and conditioner life. For this study, several key conditioner design parameters such as diamond type, diamond size, diamond shape, diamond concentration and distribution, were selected to determine their effect on CMP performance and process stability. Experimental validations were conducted. Conditioner specifications were matched to each specific CMP environment (intended application) in order to improve process stability and CMP performance particularly for emerging technology nodes. Several conditioner designs were developed and run successfully in the field. Significant planarity improvement for a 300 mm CMP process was achieved in accordance with one embodiment, and an increase of pad life and wafer polish rate was simultaneously achieved with another embodiment.

15 Claims, 4 Drawing Sheets

(56) References Cited

U.S. PATENT DOCUMENTS

| | | | |
|---|---|---|---|
| 5,152,917 | A | 10/1992 | Pieper et al. |
| 5,304,223 | A | 4/1994 | Pieper et al. |
| 5,352,493 | A | 10/1994 | Dorfman et al. |
| 5,466,431 | A | 11/1995 | Dorfman et al. |
| 5,472,461 | A | 12/1995 | Li |
| 5,492,771 | A | 2/1996 | Lowder et al. |
| 5,669,943 | A | 9/1997 | Horton et al. |
| 5,795,648 | A | 8/1998 | Goel et al. |
| 5,833,724 | A | 11/1998 | Wei et al. |
| 5,842,912 | A | 12/1998 | Holzapfel et al. |
| 5,863,306 | A | 1/1999 | Wei et al. |
| 5,976,204 | A | 11/1999 | Hammarstrom et al. |
| 5,980,678 | A | 11/1999 | Tselesin |
| 6,096,107 | A | 8/2000 | Caracostas et al. |
| 6,123,612 | A | 9/2000 | Goers |
| 6,159,087 | A | 12/2000 | Birang et al. |
| 6,200,675 | B1 | 3/2001 | Neerinck et al. |
| 6,286,498 | B1 | 9/2001 | Sung |
| 6,293,980 | B2 | 9/2001 | Wei et al. |
| 6,347,982 | B1 | 2/2002 | Holzapfel |
| 6,358,133 | B1 | 3/2002 | Cesena et al. |
| 6,368,198 | B1 | 4/2002 | Sung et al. |
| 6,416,878 | B2 | 7/2002 | An |
| 6,468,642 | B1 | 10/2002 | Bray et al. |
| 6,511,713 | B2 | 1/2003 | Mathisen et al. |
| 6,537,140 | B1 | 3/2003 | Miller et al. |
| 6,572,446 | B1 | 6/2003 | Osterheld et al. |
| 6,575,353 | B2 | 6/2003 | Palmgren |
| 6,626,167 | B2 | 9/2003 | Kim et al. |
| 6,679,243 | B2 | 1/2004 | Sung |
| 6,769,975 | B2 | 8/2004 | Sagawa |
| 6,818,029 | B2 | 11/2004 | Myoung et al. |
| 7,124,753 | B2 | 10/2006 | Sung |
| 7,258,708 | B2 | 8/2007 | Sung |
| 7,384,436 | B2 | 6/2008 | Sung |
| 7,507,267 | B2 | 3/2009 | Hall et al. |
| 7,993,419 | B2 | 8/2011 | Hall et al. |
| 8,096,858 | B2 | 1/2012 | Sakamoto et al. |
| 2002/0068518 | A1 | 6/2002 | Cesena et al. |
| 2002/0184829 | A1 | 12/2002 | Lemberger et al. |
| 2002/0197947 | A1 | 12/2002 | Sagawa |
| 2003/0036341 | A1 | 2/2003 | Myoung et al. |
| 2005/0025973 | A1 | 2/2005 | Slutz et al. |
| 2005/0076577 | A1 | 4/2005 | Hall et al. |
| 2005/0153634 | A1 | 7/2005 | Prasad et al. |
| 2005/0276979 | A1 | 12/2005 | Slutz et al. |
| 2006/0010780 | A1 * | 1/2006 | Hall et al. ..... 51/293 |
| 2006/0079162 | A1 | 4/2006 | Yamashita et al. |
| 2006/0254154 | A1 | 11/2006 | Huang et al. |
| 2007/0066194 | A1 | 3/2007 | Wielonski et al. |
| 2007/0235801 | A1 | 10/2007 | Cheng et al. |
| 2007/0259609 | A1 | 11/2007 | Liyoshi et al. |
| 2008/0153398 | A1 | 6/2008 | Sung et al. |
| 2008/0193649 | A1 | 8/2008 | Jacquet et al. |
| 2008/0271384 | A1 | 11/2008 | Puthanangady et al. |
| 2009/0053980 | A1 | 2/2009 | Hwang et al. |
| 2009/0206304 | A1 | 8/2009 | Dziomkina |
| 2009/0275274 | A1 | 11/2009 | Sakamoto et al. |
| 2010/0248595 | A1 | 9/2010 | Dinh-Ngoc et al. |
| 2010/0330886 | A1 | 12/2010 | Wu et al. |

FOREIGN PATENT DOCUMENTS

| | | | |
|---|---|---|---|
| DE | 10296547 | T5 | 5/2006 |
| EP | 1020303 | | 7/2000 |
| EP | 1208945 | | 5/2002 |
| EP | 1297928 | | 4/2003 |
| FR | 2 860 744 | A1 | 4/2005 |
| GB | 2423491 | B | 8/2006 |
| JP | 2000-127046 | A | 5/2000 |
| JP | 20020178264 | | 6/2002 |
| JP | 200353665 | | 2/2003 |
| JP | 2003048163 | A | 2/2003 |
| JP | 2003094332 | A | 4/2003 |
| JP | 2003117822 | A | 4/2003 |
| JP | 2004025377 | A | 1/2004 |
| JP | 2004066409 | A | 3/2004 |
| JP | 2004202639 | A | 7/2004 |
| JP | 3895840 | B2 | 3/2007 |
| JP | 2007-83352 | A | 4/2007 |
| JP | 2007109767 | A | 4/2007 |
| JP | 2008114334 | A | 5/2008 |
| JP | 2008186998 | A | 7/2008 |
| JP | 2008229775 | A | 10/2008 |
| KR | 1020010032812 | A | 4/2001 |
| KR | 1020020036138 | A | 5/2002 |
| WO | 9845092 | A1 | 10/1998 |
| WO | 2007/149683 | A2 | 12/2007 |
| WO | 2008/036892 | A1 | 3/2008 |
| WO | 2009/026419 | A1 | 2/2009 |

OTHER PUBLICATIONS

PCT/US2010/036895 International Search Report mailed Mar. 14, 2011, 5 pages.

PCT/US2004/28881 International Search Report mailed Dec. 23, 2004.

De Pellegrin, D.V., t al., "The Measurement and Description of Diamond Shape in Abrasion," Department of Mechanical and Manufacturing Engineering, Univeristy of Dublin, Ireland, 16 pgs.

Elmufdi, Carolina, L., et al., "The Impact of Pad Microtexture and Materials Properties on Surface Contact and Defectivity in CMP," Pad Engineering Research Group, 11th International CMP Symposium, Lake Placid, NY, Aug. 15, 2006, 18 pgs.

Hwang, Taewook et al., "Advanced Pad Conditioner Design for Oxide/Metal CMP." Saint-Gobain High Performance Materials, Transactions on Electrical and Electronic Materials, vol. 7, No. 2, Apr. 2006, pp. 62-66.

Hwang, Taewook et al., "Optimized and Customized CMP Conditioner Design for Next Generation Oxide/Metal CMP," Saint-Gobain High Performance Materials, 6 pgs.

Lawing, A. Scott, "Pad Conditioning and Textural Effects in Chemical Mechanical Polishing," Rohm and Haas Electronic Materials CMP Technologies, CMP-MIC Conference, Feb. 23-25, 2005, pp. 33-42.

Li et al, The effect of the polishing pad treatments on the chemical-mechanical polishing of SiO2 films; Thin Solid Films 270 (1995) pp. 601-606.

Stavreva et al, Characteristics in chemical-mechanical polishing of copper: comparison of polishing pads; Applied Surface Science 108 (1997) pp. 39-44.

Chan et al, A preliminary study of gentle CVDD pad dressers potential for fixed abrasives conditioning; Nov. 19-20, 2002 VMIC Conference, 2002 IMIC-400/00/0395; pp. 395-398.

Sung; CMP pad dresser: A diamond grid solution; DiaGrid(r) CMP conditioner; pp. 0-41; Kinik Co., Taiwan.

Koshy et al, surface generation with engineered diamond grinding wheels; insights from simulation; McMaster Manufacturing Research Institute; McMaster University, Hamilton, Canada; pp. 271-274.

"Diamond Grain Mesh Size/Grit Size", http://www.china-superabrasives.com/diamond_mesh_size.htm.

"Abrasive and Compounds," http://www.newportglass.com/grit.htm.

* cited by examiner (a) Random (b) Patterned (c) SARD™

OPTIMIZED CMP CONDITIONER DESIGN FOR NEXT GENERATION OXIDE/METAL CMP

RELATED APPLICATIONS

This application claims the benefit under 35 USC 119(e) of U.S. Provisional Application No. 60/965,862, filed on Aug. 23, 2007, which is incorporated herein by reference in its entirety.

FIELD OF THE INVENTION

The invention relates to abrasives technology, and more particularly, to CMP conditioners.

BACKGROUND OF THE INVENTION

As integrated circuit (IC) technology continues downsizing to 45 nanometers (nm) and 32 nm feature sizes, planarity and tight defect control are becoming increasingly important. These requirements intensify the challenges faced by suppliers of various chemical-mechanical planarization (CMP) consumables, including pads, slurries, and conditioners. During the conditioning process, it is not sufficient to simply maintain process stability by conditioning the glazed surface of the pad. In addition, the conditioner is also responsible for generating pad texture or topography which greatly influences wafer surface quality. Inappropriate conditioner selection can produce micro-scratches on the polished wafer surface and increase dishing.

Therefore, there is a need for the development of pad conditioners that meet stringent defect requirements, especially for advanced sub-50 nm) technology nodes.

SUMMARY OF THE INVENTION

One embodiment of the present invention provides an abrasive tool for CMP pad conditioning. The tool includes abrasive grains, bond, and a substrate. The abrasive grains are adhered in a single layer array to the substrate by the bond. The abrasive grains are optimized with respect to grain size, grain distribution, grain shape, grain concentration, and grain protrusion height distribution, thereby enabling a desirable CMP pad texture to be achieved. The abrasive grains can be oriented, for example, in the array according to a non-uniform pattern having an exclusionary zone around each abrasive grain, and each exclusionary zone has a minimum radius that exceeds the maximum radius of the desired abrasive grain grit size. In one particular case, at least 50% (by weight) of the abrasive grains have, independently, a particle size of less than about 75 micrometers. In another particular case, the desirable CMP pad texture is a surface finish of less than 1.8 microns or micrometers (μm), Ra. In yet another particular case, the bond that adheres the abrasive grains to the substrate is one of braze tape or braze foil. In a further particular case, the desirable CMP pad texture provided by the tool is resistant to abrasive agglomeration, thereby reducing dishing on wafers processed by the pad.

Another embodiment of the present invention provides a CMP pad conditioner. The conditioner includes abrasive grains optimized with respect to grain size, grain distribution, grain shape, grain concentration, and grain protrusion height distribution, thereby enabling a desirable CMP pad texture to be achieved (e.g., pad surface finish of less than 1.8 pm, Ra). At least 50% (by weight) of the abrasive grains have, independently, a particle size of less than about 75 micrometers.

The abrasive grains are adhered in a single layer array to a substrate by a bond (e.g., braze tape or braze foil). The abrasive grains are oriented in the array according to a non-uniform pattern having an exclusionary zone around each abrasive grain, and each exclusionary zone has a minimum radius that exceeds the maximum radius of the desired abrasive grain grit size. In one particular case, the desirable CMP pad texture provided by the tool is resistant to abrasive agglomeration, thereby reducing dishing on wafers processed by the pad.

Yet another embodiment of the present invention provides an abrasive tool for CMP pad conditioning. The tool includes abrasive grains, bond and a substrate. The abrasive grains are adhered in a single layer array to the substrate by the bond. At least 50% (by weight) of the abrasive grains have, independently, a particle size of less than about 75 micrometers, and the abrasive grains are optimized with respect to grain size, grain distribution, grain shape, grain concentration, and grain protrusion height distribution, thereby enabling a desirable CMP pad texture to be achieved. The desirable CMP pad texture provided by the tool is resistant to abrasive agglomeration, thereby providing resistance to dishing on wafers processed by the pad.

Numerous other embodiments will be apparent in light of this disclosure, including methods of conditioning a CMP pad and manufacturing techniques of that CMP pad.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

A CMP conditioner design and related techniques are disclosed. As will be appreciated in light of this disclosure, generation of optimal CMP pad texture can be achieved with an optimization of various pad conditioner design parameters. Such optimal pad texture in turn leads to reduced wafer defects.

Optimization of Conditioner Design Parameters

In accordance with embodiments of the present invention, several conditioner design parameters can be optimized to improve wafer defect rates through generation of desirable pad textures. In one particular embodiment, these design parameters include abrasive size, abrasive distribution, abrasive shape, and abrasive concentration. Each of these conditioner design parameters and it relevance to optimal pad texture will be discussed in turn.

Figure 1:
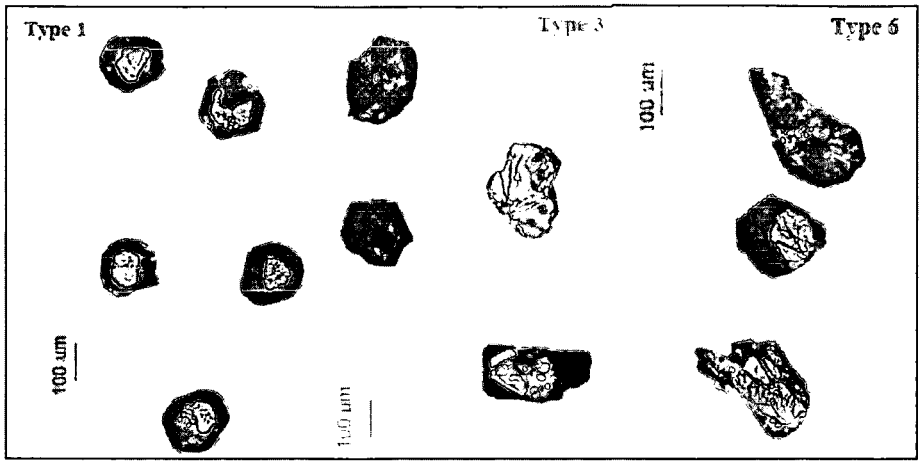
FIG. 1 illustrates optical images of Type 1, 3, and 6 diamond particles.
Figure 2:
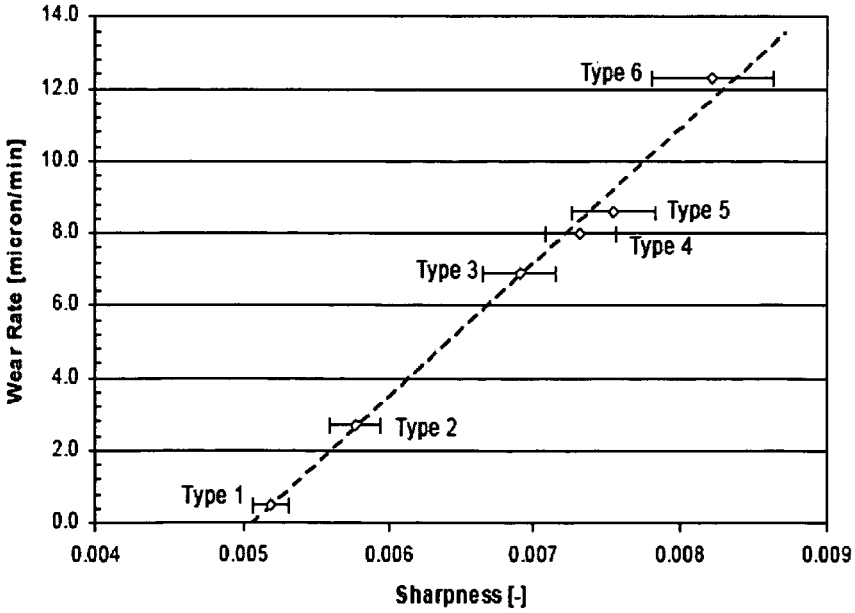
FIG. 2 illustrates the correlation between pad wear rate and diamond sharpness for six abrasive types.

Abrasive Type: Diamond is a typical abrasive used in CMP conditioner applications. Appropriate selection of diamond type is considered, as it can directly influence resulting pad surface texture. Various diamond types can be characterized in terms of several shape parameters such as aspect ratio, convexity, and sharpness. In accordance with principles underlying various embodiments of the present invention, six types of diamond particles were studied. As can be seen, FIG. 1 shows optical microscope images of three selected types (Types 1, 3, and 6 are shown; Types 2, 4, and 5 can be inferred, as irregularity increases as the type number increases). Type 1 in FIG. 1 consists of octahedral and cubo-octahedral grains wherein the corners are truncated and particles possess the least abrasiveness. Type 3 has more sharp corners with more abrasiveness, relative to Types 1 and 2. Type 6, is the most irregular in shape of all the Types 1 through 6. Such abrasive particles are vulnerable to diamond fracture, which can produce scratches on the wafer and therefore are not usually suitable for CMP conditioner applications. Hence selection of diamond abrasive type for CMP conditioners requires an appropriate balance between shape and fracture resistance. CMP conditioners were manufactured with the six types of diamond particles, and pad cut rate was generated on a polyurethane CMP pad to estimate conditioner aggressiveness. The results were then further correlated to sharpness of each abrasive type. The relationship between sharpness and pad wear rate follows linear behaviour as shown in FIG. 2, with a correlation coefficient close to 1. In general, as sharpness of abrasive type increases, pad wear rate increases. Thus, the sharpness can be effectively used to predict diamond aggressiveness in terms of pad cut rate.

Figure 3:
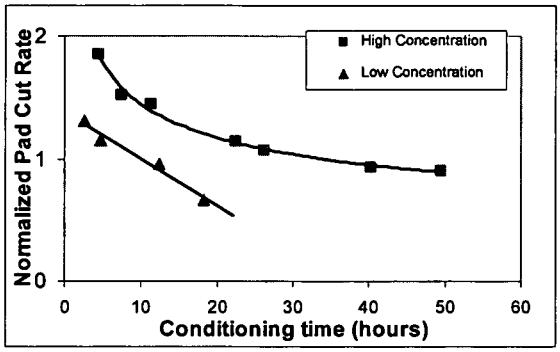
FIG. 3 illustrates a pad wear rate curve of two designs, high and low diamond concentration.

Diamond Concentration and Size: Selection of diamond size and concentration are interrelated, in accordance with one particular embodiment of the present invention. The number of diamond particles that can be placed on a conditioner surface is limited by particle size. With finer sizes, the number of diamond particles can be significantly increased. For a given diamond size, an increase of diamond concentration increases pad cut rate. The time dependent conditioner behavior can be estimated by measuring pad cut rate over the dresser life (a conditioning pad is sometimes referred to as a dresser). Two conditioners, manufactured with low and high diamond concentrations respectively, were tested and pad wear rate was measured over the conditioning time. The pad cut rate curves, shown in FIG. 3, clearly reveal different time dependent behavior. The conditioner with the higher diamond concentration shows more stable performance after the initial break-in period and longer dresser life, but shorter pad life due to the higher pad cut rate. U.S. Provisional Application No. 60/846,416, titled "Conditioning Tool for Chemical Mechanical Planarization", filed Sep. 22, 2006; U.S. Non-Provisional Patent Application No. 11/857,499, filed Sep. 19, 2007; and International Publication No. WO 2008/036892 Al, titled "Conditioning Tools and Techniques for Chemical Mechanical Planarization", published on Mar. 27, 2008, the teachings of all three being incorporated herein by reference in their entirety, provide additional details about CMP conditioners, including use of fine diamond (e.g., 75 microns and smaller).

As described in this application, tools for conditioning CMP pads can be produced by coupling abrasive particles, e.g., by brazing, sintering or electroplating, to at least one of the front and back sides of a support member. The front side and the back side of the support preferably are substantially parallel to one another and the tool preferably is manufactured to have an out-of-flatness of less than about 0.002 inch. In one example, at least 50% (by weight) of the abrasive particles, e.g., diamond particles, have a particle size of less than 75 micrometers. In other examples, 95% (by weight) of the abrasive particles have a particle size of less than about 85 micrometers. The abrasive particles can form a pattern including a subpattern such as SARD™ (further discussed below), a face centered cubic, cubic, hexagonal, rhombic, spiral or random pattern and can have a particle concentration greater than about 4000 abrasive particles/inch$^2$ (620 abrasive particles/cm$^2$). In specific examples, the abrasive particles are coupled by brazing alloy using a brazing film, e.g., braze tape, braze foil, braze tape with perforations or braze foil with perforations. The brazing film can have a thickness, that is, e.g., of about 60% or less of the smallest particle size of the abrasive particles.

Figure 4:
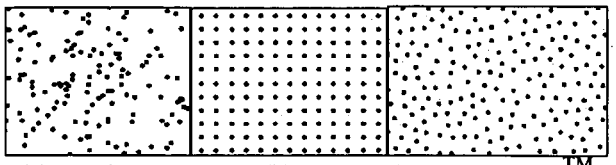
FIG. 4 illustrates various diamond distributions on a conditioner surface.

Diamond Distribution: Traditionally, diamond grains generally have been placed on the conditioner surface in either random distribution or patterned distribution, as illustrated in FIG. 4 (*a, b*). A randomly distributed conditioner may have repeatability and reproducibility problems due to its inherent lack of manufacturing consistency. A conditioner with a regular patterned array has inherent periodicity of diamond in Cartesian coordinates which may imprint undesirable regularity on the pad. A self-avoiding random distribution (SARD™), as illustrated in FIG. 4 (*c*) and in accordance with an embodiment of the present invention, was developed by Saint-Gobain Abrasives to overcome both shortcomings. In general, a SARD™ array can be designed so that there is no repeat pattern, and also no diamond free zones which are expected in truly random arrays. Furthermore, each SARD™ conditioner is fabricated with exact duplication of each diamond position and has superior polishing performance in terms of process stability, lot-to-lot consistency, and wafer uniformity. Some polishing data is presented in later sections for comparison of the three types of diamond distributions. U.S. Patent Application Publication No. 2006/0010780, published on Jan. 19, 2006, and titled "Abrasive Tools Made with a Self-Avoiding Abrasive Grain Array," the teachings of which are incorporated herein by reference in their entirety, provides additional details about SARD™.

For example, U.S. Patent Application Publication No. 2006/0010780 describes abrasive tools that include abrasive grains, bond and a substrate, the abrasive grains having a selected maximum diameter and a selected size range, and the abrasive grains being adhered in a single layer array to the substrate by the bond, characterized in that: (a) the abrasive grains are oriented in the array according to a non-uniform pattern having an exclusionary zone around each abrasive grain, and (b) each exclusionary zone has a minimum radius that exceeds the maximum radius of the desired abrasive grain grit size.

A method for manufacturing abrasive tools having a selected exclusionary zone around each abrasive grain, includes the steps of (a) selecting a two-dimensional planar area having a defined size and shape; (b) selecting a desired abrasive grain grit size and concentration for the planar area; (c) randomly generating a series of two-dimensional coordinate values; (d) restricting each pair of randomly generated coordinate values to coordinate values differing from any neighboring coordinate value pair by a minimum value (k); (e) generating an array of the restricted, randomly generated coordinate values having sufficient pairs, plotted as points on a graph, to yield the desired abrasive grain concentration for the selected two dimensional planar area and the selected abrasive grain grit size; and centering an abrasive grain at each point on the array.

Another method for manufacturing abrasive tools having a selected exclusionary zone around each abrasive grain, comprising the steps of (a) selecting a two-dimensional planar area having a defined size and shape; (b) selecting a desired abrasive grain grit size and concentration for the planar area; (c) selecting a series of coordinate value pairs ($x_1$, $y_1$) such that the coordinate values along at least one axis are restricted to a numerical sequence wherein each value differs from the next value by a constant amount; (d) decoupling each selected coordinate value pair ($x_1$, $y_1$) to yield a set of selected x values and a set of selected y values; (e) randomly selecting from the sets of x and y values a series of random coordinate value pairs (x, y), each pair having coordinate values differing from coordinate values of any neighboring coordinate value pair by a minimum value (k); (f) generating an array of the randomly selected coordinate value pairs having sufficient pairs, plotted as points on a graph, to yield the desired abrasive grain concentration for the selected two dimensional planar area and the selected abrasive grain grit size; and (g) centering an abrasive grain at each point on the array.

Experimental Validation

Three CMP conditioner designs manufactured in accordance with embodiments of the present invention (SGA-A, SGA-B, and SGA-C, respectively) and two conventional CMP conditioner designs by Conventional-A and Conventional-B, respectively, were selected and tested to compare dresser performance. For SGA-A, B and C, all were manufactured with the same diamond SARD™ distribution and advanced brazing technology, including the use of braze films (e.g., braze tapes and foils) as discussed in U.S. Provisional Application No. 60/846,416; U.S. Non-Provisional Application No. 11/857,499; or International Publication No. WO 2008/036892 A1. Compared with braze paste, brazing tape and brazing foil have the advantage that they produce a consisting braze allowance (thickness of braze). Compared with braze paste and brazing tape, brazing foil melts more uniformly and quickly allowing for higher productivity in the manufacture of CMP dressers. Specifications of SGA-A and B are the same except that SGA-A employs a less aggressive diamond. Conventional-A is an electroplated product with regular diamond distribution, whereas Conventional-B is a brazed product with randomly distributed diamond.

Analysis of Pad Surface and Pad Cut Rate: Ex-situ conditioning was conducted on a commercial polyurethane double stacked pad with five dressers listed in Table 1 with 12 lbf of conditioning down force on the polishing tool. Surface roughness and pad cut rate were measured by a profiler and a sensor connected to a computer data acquisition system. The pad surface finish $R_a$ (μm) and normalized pad cut rate are also listed in Table 1. The surface roughness generated by SGA-A and SGA-B dressers was smoother than the Conventional-A and B dressers. Further note that the pad cut rate of the Conventional-B dresser is the lowest among the five but the Ra value is the highest. As previously mentioned, a rough pad surface is not desirable for advanced sub-50 nm CMP processes due to a higher probability of producing defects on the wafer.

TABLE 1

Detail conditioner specifications and the results of $R_a$ and pad cut rate.

| | Diamond Shape | Size | Distribution | Concentration | Bonding | Ra (μm) | Pad cut rate (Arb Unit) |
|---|---|---|---|---|---|---|---|
| SGA-A | Cubo Octahedron | 76 | SARD ™ | 32 | Brazed | 1.44 | 1 |
| SGA-B | Truncated Octahedron | 76 | SARD ™ | 32 | Brazed | 1.54 | 1.2 |
| SGA-C | Truncated Octahedron | 126 | SARD ™ | 16 | Brazed | 1.88 | 1 |
| Conventional-A | Irregular Cubo Octahedron | 151 | Patterned | 6 | Electroplated | 1.86 | 1.4 |
| Conventional-B | Irregular blocky | 181 | Random | 2 | Brazed | 1.97 | 0.7 |

Figure 5:
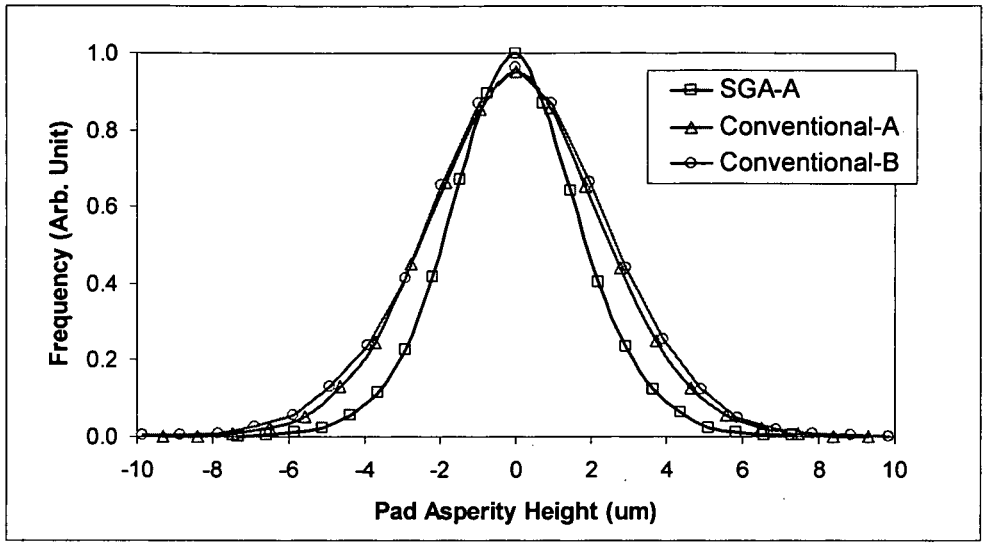
FIG. 5 illustrates pad asperity height distribution.

This can be further evidenced by pad asperity analysis. The pad asperity height distributions, obtained from the conditioned pads, revealed that the distribution with SGA-A was much more uniform compared to the other two, as shown in FIG. 5. This tighter and more uniform asperity distribution should increase contact area between the pad and the wafer and therefore reduce localized high pressure peaks, which will reduce wafer defects. Pad manufacturers also try to increase contact area between the pad and wafer to reduce defects.

Figure 6:
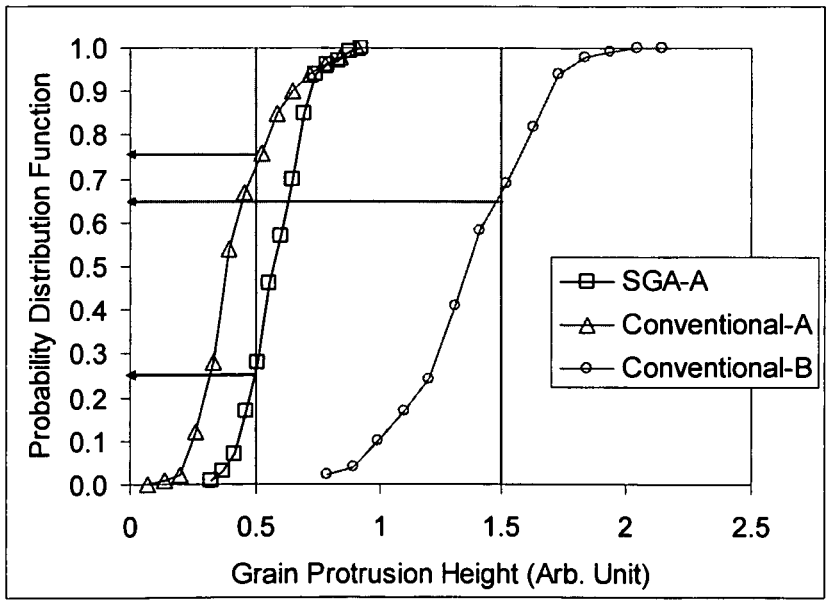
FIG. 6 illustrates probability of diamond protrusion height distribution function.

Similarly to the case of contact area analysis between the pad and the wafer, the contact point between the pad and the diamond abrasives during conditioning can be estimated by generating a probability distribution function of diamond protrusion height as shown in FIG. 6. Since the X-axis represents the protrusion height of the grains, and if it is assumed that the active conditioning grains are above 0.5 of the normalized grain height (the vertical lines in FIG. 6), the number of active conditioning grains can be estimated.

From FIG. 6, the percentages of the estimated active conditioning grains for Conventional-A and B are about 25% and 30%, respectively, whereas the percentage of SGA-A is above 75%. The average protrusion height of Conventional-B is about three times higher than that of SGA-A and Conventional-A. The ratio of the number of active conditioning grains of SGA-A to that of Conventional-A can be estimated as (C1 *0.75)/(C3*0.25), where C1 equals 32 and C3 equals 6 (as can be seen in Table 1). This difference in number of active conditioning grains will also play a significant role in determining the different surface finishes and pad asperity height distributions in Table 1 and FIG. 5.

CMP Test

Experimental validations were conducted to compare conditioner performance in terms of wafer defect rates, material (wafer) removal rate (MRR), and uniformity. Two previously discussed designs, SGA-B and Conventional-A, were selected for benchmark testing both in a lab setting (SGA Lab) and in a Fab setting (Fab1). The SGA Lab test was conducted with an in-situ 100% conditioning mode with a fixed down force of 5 lbf. The polishing and conditioning recipes at both testing sites were different. The results listed in Table 2 show that the wafer removal rate with SGA-B is higher than that with Conventional-A. The defect rate with SGA-B is also lower than Conventional-A, while the WIWNU (Within-Wafer-Nonuniformity) is comparable for both dressers.

TABLE 2

CMP performance data comparison

| | SGA Lab Data | | Fab1 Data | |
|---|---|---|---|---|
| | SGA-B | Conventional-A | SGA-B | Conventional-A |
| MRR (A/mm) | 2589 | 2427 | 5860 | 5327 |
| WIWNU (%) | 10.4 | 11.2 | 9.2 | 10.3 |
| Defect (Arb Unit) | N/A | N/A | 220 | 330 |

Table 3 also shows CMP data obtained from the patterned wafers from another Fab (Fab 2). Both SGA-A and Conventional-A were qualified for a given dresser life and no attempt was made to test beyond this time. Again, the removal rate with SGA-A is about 10% higher than Conventional-A, even with 35% longer pad life. This clearly indicates that an optimal conditioner design can achieve both higher wafer removal rate and longer pad life.

TABLE 3

CMP performance data from production patterned wafers

| | Fab2 Data | |
|---|---|---|
| | SGA-A | Conventional-A |
| Conditioner life (%) | 100 | 100 |
| Pad Life (%) | 135 | 100 |
| MRR (%) | 110 | 100 |

Figure 7:
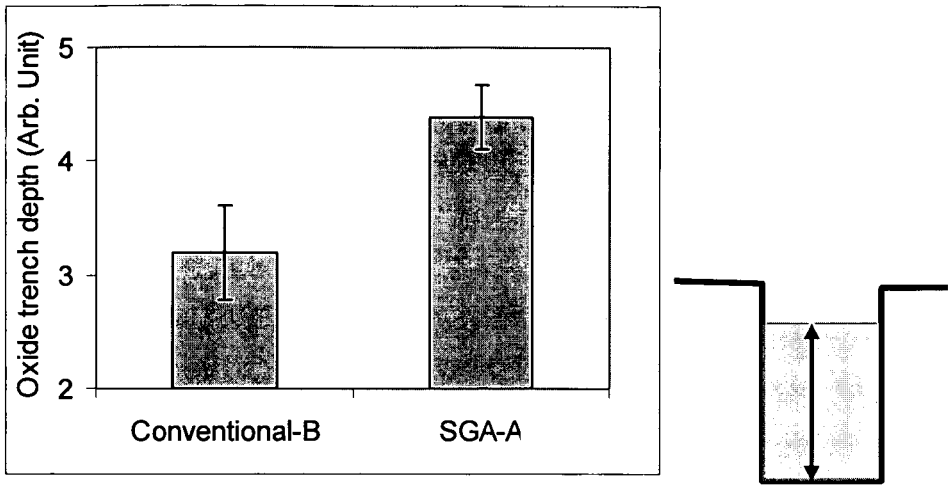
FIG. 7 illustrates post-CMP oxide trench depth from 300 mm production wafers.

FIG. 7 illustrates planarity data of post-CMP oxide trench depth obtained from 300 mm production patterned wafers. As can be seen, the average oxide remaining trench depth with SGA-A is significantly higher than that with Conventional-B. This result clearly demonstrates improvement in dishing, with the improvement being attributed to the optimized SGA-A conditioner design. In more detail, the SGA-A conditioner imparts an optimized texture to the pad surface. That textured pad surface has smaller grooves and features, which are more resistant to agglomerating or otherwise trapping significant amounts of slurry (or abrasive material) during wafer polishing. Such agglomerates and/or large collections of slurry that occur in larger pad grooves/features (caused by conventional pad conditioners) operate to cut more aggressively, thereby removing more of the trench layer which ultimately leads to dishing (essentially, a dimple in the layer deposited onto the trench layer of the wafer being processed). In this sense, a pad conditioner configured in accordance with an embodiment of the present invention operates to reduce dishing.

Thus, optimization of key conditioner design parameters such as abrasive size, abrasive distribution, abrasive shape, abrasive concentration, abrasive protrusion height distribution, and asperity distribution has demonstrated the generation of desirable pad textures and therefore reduced wafer defect rates. Benefits of conditioners optimized in accordance with embodiments of the present invention have been validated for advanced sub-50 nm CMP processes where tight control of defects is critical to further successful integration of subsequent IC manufacturing processes.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An abrasive tool for chemical-mechanical planarization (CMP) pad conditioning, comprising abrasive grains, bond and a substrate, the abrasive grains being adhered in a single layer array to the substrate by the bond, wherein a percentage of active conditioning abrasive grains is greater than 75%, the active conditioning abrasive grains having a height above 0.5 times a normalized grain height.

2. The abrasive tool of claim 1 wherein the abrasive grains are oriented in the array according to a non-uniform pattern having an exclusionary zone around each abrasive grain, and each exclusionary zone has a minimum radius that exceeds the maximum radius of the desired abrasive grain grit size.

3. The abrasive tool of claim 1 wherein at least 50% (by weight) of the abrasive grains have, independently, a particle size of less than about 75 micrometers.

4. The abrasive tool of claim 1 wherein a desirable CMP pad texture is a surface finish of less than 1.8 μm, Ra.

5. The abrasive tool of claim 1 wherein the bond that adheres the abrasive grains to the substrate is one of braze tape or braze foil.

6. The abrasive tool of claim 1 wherein at least 95% (by weight) of the abrasive grains have a particle size of less than 85 μm.

7. A CMP pad conditioner, comprising:

bond;

abrasive grains optimized with respect to grain size, grain distribution, grain shape, grain concentration, and grain protrusion height distribution, thereby enabling a desirable CMP pad texture to be achieved, wherein at least 50% (by weight) of the abrasive grains have, independently, a particle size of less than about 75 micrometers; and a substrate, the abrasive grains being adhered in a single layer array to the substrate by the bond;

wherein the abrasive grains are oriented in the array according to a non-uniform pattern having an exclusionary zone around each abrasive grain, and each exclusionary zone has a minimum radius that exceeds the maximum radius of the desired abrasive grain grit size, wherein a percentage of active conditioning abrasive grains is greater than 75%, the active conditioning abrasive grains having a height above 0.5 times a normalized grain height; and wherein a concentration of the abrasive grains is greater than about 620 abrasive grains/$cm^2$.

8. The CMP pad conditioner of claim 7 wherein the desirable CMP pad texture is a surface finish of less than 1.8 μm, Ra.

9. The CMP pad conditioner of claim 7 wherein the bond that adheres the abrasive grains to the substrate is one of braze tape or braze foil.

10. The CMP pad conditioner of claim 7 wherein the desirable CMP pad texture provided by the tool is resistant to abrasive agglomeration, thereby reducing dishing on wafers processed by the pad.

11. An abrasive tool for CMP pad conditioning, comprising abrasive grains, bond and a substrate, the abrasive grains being adhered in a single layer array to the substrate by the bond, wherein at least 50% (by weight) of the abrasive grains have, independently, a particle size of less than about 75 micrometers, and the abrasive grains are optimized with respect to grain size, grain distribution, grain shape, grain concentration, and grain protrusion height distribution, thereby enabling a desirable CMP pad texture to be achieved.

12. The abrasive tool for CMP pad conditioning of claim 11, wherein the abrasive tool has an out-of-flatness of less than about 0.002 in.

13. The abrasive tool for CMP pad conditioning of claim 1, wherein a shape of the abrasive grains comprises a combination of cubo-octahedron and octahedron or truncated octahedron.

14. The abrasive tool for CMP pad conditioning of claim 1, wherein a shape of the abrasive grains is substantially not irregular.

15. The abrasive tool for CMP pad conditioning of claim 1, wherein the abrasive grains are arranged in a self-avoiding random distribution.

* * * * *